United States Patent [19]

Smith

[11] Patent Number: 4,872,237

[45] Date of Patent: Oct. 10, 1989

[54] CHALK DUST REMOVER

[76] Inventor: Lloyd J. Smith, 1601 E. Jackson, Lot #30, Macomb, Ill. 61455

[21] Appl. No.: 802,319

[22] Filed: Nov. 25, 1985

[51] Int. Cl.[4] ..... A47L 25/00

[52] U.S. Cl. ..... 15/210 R; 15/221; 15/244.1; 434/417

[58] Field of Search ..... 15/221, 222, 209 R, 15/210 R, 198, 209, 118, 142; 206/45.21, 45.28, 244 R; 220/1 T; 434/417

[56] References Cited

U.S. PATENT DOCUMENTS

| | | | |
|---|---|---|---|
| 365,356 | 6/1887 | Travis | 15/221 |
| 388,555 | 8/1888 | Goodrich . | |
| 406,650 | 7/1889 | Jones | 15/221 |
| 511,812 | 1/1894 | Spence | 15/221 |
| 521,258 | 6/1894 | Creamer | 15/221 |
| 522,469 | 7/1894 | Kious | 15/221 |
| 531,696 | 1/1895 | Pechin | 15/221 |
| 559,765 | 5/1896 | Becker | 15/221 |
| 582,612 | 5/1897 | Barrie | 5/221 |
| 618,759 | 1/1899 | Yea | 15/221 |
| 647,013 | 4/1900 | Mecredy | 15/221 |
| 665,637 | 1/1901 | Grey | 15/221 |
| 905,450 | 12/1908 | McAllister | 434/417 |
| 923,262 | 6/1909 | Hainline | 434/417 |
| 1,062,311 | 5/1913 | Wallace | 434/417 |
| 1,092,535 | 9/1914 | McClintock | 15/221 |
| 2,203,728 | 6/1940 | Hutchinson | 15/231 |
| 2,249,912 | 7/1941 | Oxley | 15/118 |
| 2,257,600 | 9/1941 | Fuchs | 15/104 |
| 2,894,618 | 7/1959 | Matteson | 206/45.28 |
| 3,444,579 | 8/1969 | Thomford | 15/210 R |
| 3,703,739 | 11/1972 | Young | 15/118 |
| 3,737,938 | 6/1973 | Saltzstein | 15/231 |
| 3,748,684 | 7/1973 | Fraser | 15/244 R |
| 3,751,746 | 8/1973 | Elbreder | 15/221 |
| 3,857,133 | 12/1974 | Linenfelser | 15/118 |
| 3,986,224 | 10/1976 | Yang | 15/221 |
| 3,996,639 | 12/1976 | Griffin | 15/229 B |
| 4,099,286 | 7/1978 | Ishikawa | 15/142 |
| 4,202,139 | 5/1980 | Hong | 15/227 |
| 4,462,134 | 7/1984 | Wang | 15/97 R |
| 4,543,680 | 10/1985 | Vlahos | 15/209 R |
| 4,596,059 | 6/1986 | Lee | 15/221 |
| 4,665,580 | 5/1987 | Morris | 15/118 |

FOREIGN PATENT DOCUMENTS

| | | | |
|---|---|---|---|
| 2090123 | 7/1982 | United Kingdom | 15/210 R |

OTHER PUBLICATIONS

Gershman, Journal of American Medical Association, vol. 168, No. 7, "Self-Adhering Nylon Tapes", p. 980, 10/1958.

*Primary Examiner*—Harvey C. Hornsby
*Assistant Examiner*—Joseph S. Machuga
*Attorney, Agent, or Firm*—Bacon & Thomas

[57] ABSTRACT

A chalk dust remover is disclosed to remove the chalk dust which has accumulated on the surface of a chalk board cleaner. The device has a housing, a perforated support member, and a sheet of porous, open cell foam material which extends over the support member and is attached to the housing. The chalk board cleaner is rubbed over the foam material which causes the chalk dust to be removed and passed through the foam material and the perforated support, and into a receiving chamber within the housing. The foam material is releasably attached to the housing by engagement with a hook portion of a releasable hook and loop type fastener.

5 Claims, 1 Drawing Sheet

FIG. 1
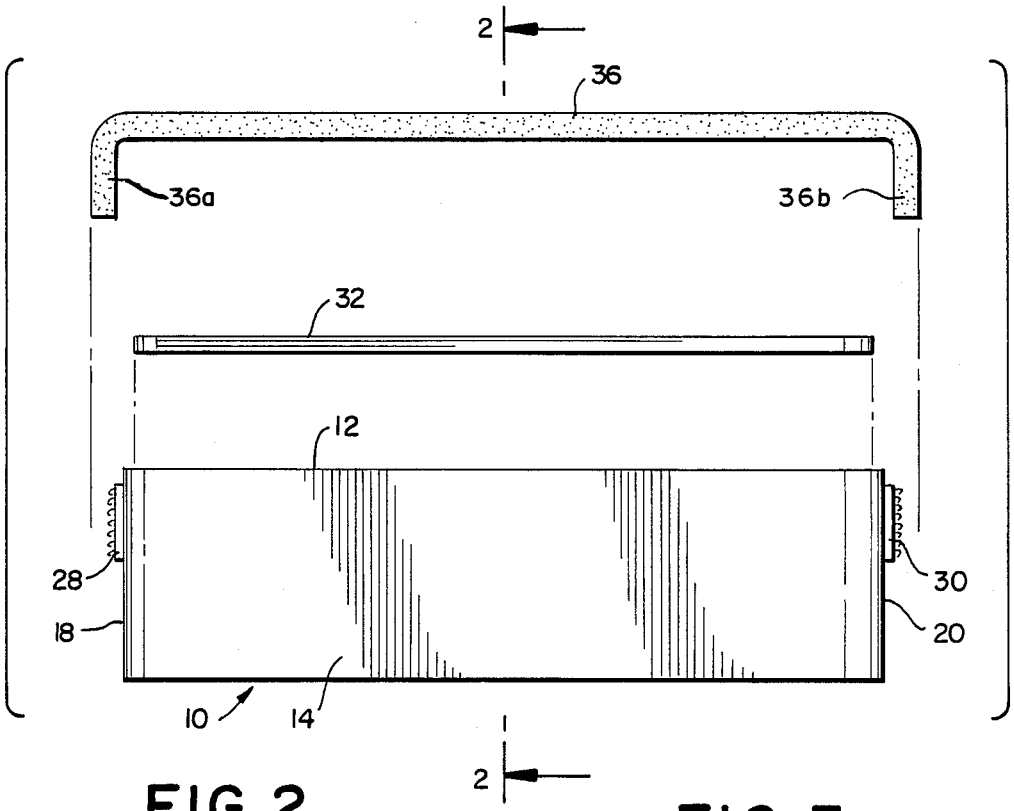
FIG. 2
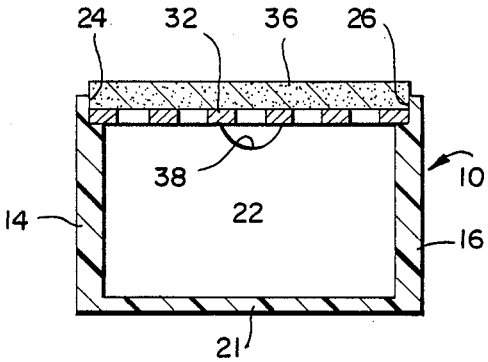
FIG. 3
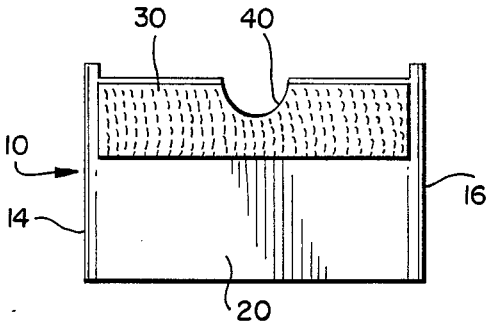
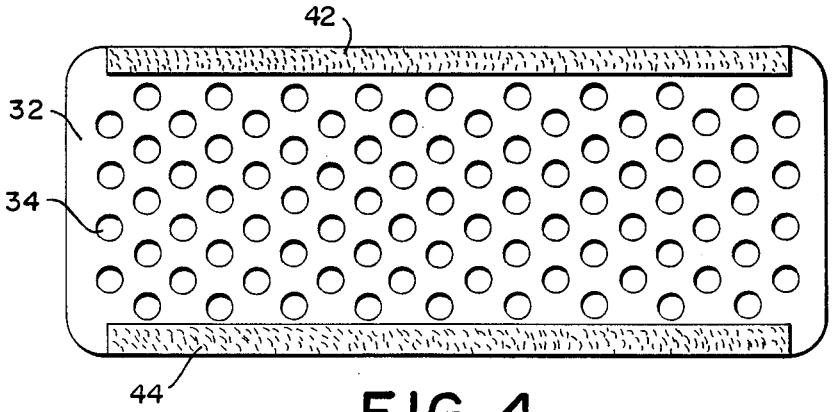
FIG. 4

CHALK DUST REMOVER

FIELD OF THE INVENTION

The present invention relates to a device for removing accumulated chalk dust from a chalk board cleaner.

BRIEF DESCRIPTION OF THE PRIOR ART

The prior art is replete with chalk board cleaning devices. Such prior art chalk board cleaners have included those with removable cleaning surfaces; those with chambers for entrapping the chalk dust; and those having a porous chalk removing surface. Typical of such prior art devices, the handle or gripping means defines a chamber to trap and retain the chalk dust while the cleaning surface, which may be a porous material, is attached to the handle.

The cleaning surface of the chalk board cleaners will, however, eventually become clogged with chalk dust and means must be provided to clean them to insure that they will regain their cleaning capabilities. The oil cloths which are presently used to clean the leather cleaning surface of chalk board cleaners are effective to remove the chalk dust, but tend to smooth over the leather thereby decreasing its cleaning efficiency. This also serves to shorten the useful life of the chalk board cleaner.

SUMMARY OF THE INVENTION

The present invention defines a device for removing the chalk dust from the cleaning element of a chalk board cleaner. The device comprises a housing which defines a receiving chamber, the housing being shaped so as to be easily gripped by the user; a perforated support member disposed over an open side of the housing; and a sheet of porous, open celled foam material extending over the outer surface of the perforated support member and being attached to the housing at either end. The attachment to the housing is accomplished by attaching fastening segments to each end of the housing. Each of the fastening segments comprises the hook portion of a releasable hook and loop type fastener, such as Velcro. The hook portions of the fastening segments grip the porous, open celled foam material to keep it from moving relative to the support member and the housing.

The cleaning surface of the chalk board cleaner is rubbed back and forth in contact with the porous, open celled foam material which serves to remove the chalk dust from the chalk board cleaner. The foam material is such that the chalk dust passes through this layer, as well as the perforated support member and is entrapped in the housing. The rough surface of the open celled foam material not only cleans the surface of the chalk board cleaner but retains it in condition for optimum efficiency and maximum usage life.

BRIEF DESCRIPTION OF THE DRAWINGS

FIG. 1 is an exploded, side elevational view of the chalk dust remover according to the invention.

FIG. 2 is a sectional view taken along line 2—2 in FIG. 1 showing the chalk dust remover in assembled condition.

FIG. 3 is an end elevational view of the housing shown in FIG. 1.

FIG. 4 is a top plan view of the perforated support member utilized with the invention.

DETAILED DESCRIPTION OF THE PREFERRED EMBODIMENT

The chalk dust remover according to the invention comprises a housing 10 having a generally parallelepiped shape with an open side 12 facing upwardly as shown in FIG. 1. Sides 14 and 16, along with ends 18 and 20, and bottom 21 define receiving chamber 22. The distal edge portions of sides 14 and 16 may define elongated notches 24 and 26, respectively.

Fastening segments 28 and 30 are attached to ends 18 and 20 of housing 10. These fastening segments comprise the hook portion of a releasable hook and loop type fastener, such as Velcro.

Perforated support member 32 extends over open side 12 of housing 10 and rests in notches 24 and 26. Support member 32 may be formed of any generally rigid material which may be formed with a plurality of holes 34 extending through its thickness.

A sheet of porous, open celled foam material 36 extends over the exterior surface of perforated support member 32. The length of foam material 36 is greater than the length of the housing 10 such that end portions **36*a* and 36*b* may be bent downwardly so as to engage fastening segments 28 and 30. The engagement of the hook portions 28 and 30 with the open celled foam material serves to retain the sheet 36, as well as the support member 32 attached to housing 10. The open celled foam material 36 may be any type of flexible foam material whose cells are open sufficiently to allow the chalk dust to pass therethrough. It has been found that open celled foam media sold under the name "KWIK KUTS" Part No. KK500F is sufficiently porous to properly clean the chalk board cleaner surface, while allowing the chalk dust to pass through it into the receiving chamber 22**.

In operation, the above described elements are assembled as shown in FIG. 2 and the chalk board cleaner is rubbed back and forth across open celled foam material so as to remove the chalk dust therefrom. The chalk dust passes through the sheet of foam materal 36 and through the perforated supporting member 32 into the receiving chamber 22. When it is desired to empty the accumulated chalk dust in chamber 22, or to change the open-celled foam material 36, it need be merely disengaged from fastening segments 28 and 30. Notches 38 and 40 are defined in ends 18 and 20, respectively, and allow either end of the perforated support member 32 to be manually engaged to facilitate its removal from housing 10. Once the elements have been disassembled, it is merely necessary to turn over the housing 10 and to empty the chalk dust contained in the receiving chamber.

Perforated support member 32 may have additional fastening segments 42 and 44 extending along its lateral edges, as shown in FIG. 4. These fastening segments also comprise the hook portion of a releasable hook and loop type fastener and serves to engage the underside of open celled foam material 36 to more firmly hold the foam material in place. It is to be understood, however, that these additional fastening segments may be eliminated without exceeding the scope of the invention. It is also possible to utilize different forms of perforated support material, such as a wire screen, or the like, without exceeding the scope of this invention.

The foregoing description is provided for illustrative purposes only and should not be construed as in any way limiting this invention, the scope of which is defined solely by the appended claims.

What is claimed is:

1. A device for removing accumulated chalk dust from a cleaning surface of a chalkboard cleaner comprising:

(a) a housing having an exterior surface and defining a receiving chamber having an open side for receiving chalk dust from the chalkboard cleaner;

(b) a support member releasably mounted on the housing so as to extend across the open side of the receiving chamber, the support member defining a plurality of holes extending therethrough in communication with the receiving chamber to allow passage of chalk dust through the support member into the receiving chamber;

(c) means for removing chalk dust from the chalkboard cleaner comprising a sheet of porous, open cell foam material having downwardly turned end portions, the sheet extending over the support member and defining an exposed, rough surface adapted to contact the cleaning surface of the chalkboard cleaner such that relative sliding contact between the exposed rough surface of the sheet and the cleaning surface of the chalkboard cleaner removes accumulated chalk dust therefrom whereby the open cells of the foam material allow the removed chalk dust to pass therethrough into the openings of the support member; and (d) attachment means located on the exterior surface of the housing so as to removably attach said opposite end portions of the sheet of foam material to the housing.

2. The chalk dust removing device according to claim 1 further comprising fastening segments attached to an exterior surface of the perforated support member, the fastening segments comprising the hook portion of a releasable hook and loop type fastener so as to grip the porous, open cell material to thereby attach the porous, open cell material to the support member.

3. The chalk dust removing device according to claim 2 wherein opposite sides of the housing contact opposite edges of the support member so as to inhibit lateral movement of the perforated support member with respect to the housing.

4. The chalk dust removing device according to claim 3 wherein the ends of the housing define notches adjacent the open side of the receiving chamber to facilitate removal of the support member.

5. The chalk dust removing device according to claim 1 wherein the attachment means to attach the end portions of the sheet of porous, open cell foam material to the housing comprises fastening segments attached to the housing, each fastening segment comprising a hook portion of a releasable hook and loop type fastener.

* * * * *